United States Patent [19]

Karol et al.

[11] Patent Number: 4,554,086

[45] Date of Patent: Nov. 19, 1985

[54] BORATE ESTERS OF HYDROCARBYL-SUBSTITUTED MONO- AND BIS-SUCCINIMIDES CONTAINING POLYAMINE CHAIN LINKED HYDROXYACYL GROUPS AND LUBRICATING OIL COMPOSITIONS CONTAINING SAME

[75] Inventors: Thomas J. Karol, Wappingers Falls; Harold S. Magaha, Poughkeepsie, both of N.Y.

[73] Assignee: Texaco Inc., White Plains, N.Y.

[21] Appl. No.: 604,188

[22] Filed: Apr. 26, 1984

[51] Int. Cl.[4] ..... C10M 1/54; C10M 3/48; C09D 5/04

[52] U.S. Cl. ..... 252/49.6; 548/110

[58] Field of Search ..... 548/110; 252/51.5 A, 252/49.6

[56] References Cited

U.S. PATENT DOCUMENTS

| | | | |
|---|---|---|---|
| 3,030,375 | 4/1962 | DeGray et al. | 548/110 |
| 3,446,808 | 5/1969 | Cyba et al. | 548/110 |
| 4,428,849 | 1/1984 | Wisotsky | 252/51.5 A |
| 4,448,703 | 5/1984 | Forsberg | 252/51.5 A |
| 4,478,732 | 10/1984 | Horodysky et al. | 548/110 |
| 4,502,970 | 3/1985 | Schetelick | 252/49.6 |

*Primary Examiner*—Joseph L. Schofer
*Assistant Examiner*—Peter F. Kulkosky
*Attorney, Agent, or Firm*—Robert A. Kulason; James J. O'Loughlin; Carl G. Seutter

[57] ABSTRACT

Lubricating oils of improved wear resistance and dispersancy are prepared containing borate esters of hydrocarbyl-substituted mono- and bis-succinimides containing polyamine chain linked hydroxyacyl groups.

27 Claims, No Drawings

BORATE ESTERS OF HYDROCARBYL-SUBSTITUTED MONO- AND BIS-SUCCINIMIDES CONTAINING POLYAMINE CHAIN LINKED HYDROXYACYL GROUPS AND LUBRICATING OIL COMPOSITIONS CONTAINING SAME

FIELD OF THE INVENTION

This invention relates to lubricating oils of improved wear resistance and detergency. More particularly it relates to lubricating oils containing a novel additive.

BACKGROUND OF THE INVENTION

As is well known to those skilled in the art, lubricating oils may be improved by addition thereto of a wide range of additives. Many of these additives are useful to improve the detergency or wear-resistant properties of a lubricating oil. Typical of the many prior art disclosures relating to such additives may be the following patents: U.S. Pat. Nos. 3,172,892, 4,048,080, 2,568,876, 3,126,936, 3,131,150, 4,338,205 and Netherlands Pat. No. 7,509,289 etc.

Assignee's copending application Ser. No. 465,941, filed Feb. 14, 1983, for Hydrocarbyl-substituted Mono- and bis Succinimide having Polyamine Chain-Linked Hydroxyacyl Radicals and Mineral Oil Compositions Containing Same by Thomas J. Karol, Raymond C. Schlicht, and Harold S. Magaha discloses additives which are shown to be characterized by their ability to inhibit elastomer seal deterioration and by their improved dispersancy. The disclosure of that application is incorporated herein by reference thereto. The references disclosed in that application (together with U.S. Pat. No. 3,185,704 cited therein) provide additional background.

It is an object of this invention to provide a novel lubricating oil characterized by its improved wear resistant properties and by its improved dispersant properties. Other objects will be apparent to those skilled in the art.

STATEMENT OF THE INVENTION

In accordance with certain of its aspects, this invention is directed to a hydrocarbyl-substituted mono-or bis-succinimide containing polyamine chain-linked hydroxyacyl radicals characterized by the formula

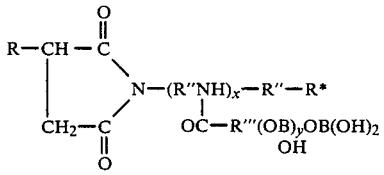

wherein

R is a hydrocarbyl group containing about 8–400 carbon atoms;

R″ is a divalent hydrocarbon group;

x is 1–6;

y is 0–3;

R‴ is a divalent hydrocarbon group;

R* is —$NH_2$, —N(H)R″H

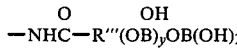

or a hydrocarbyl-substituted succinyl group

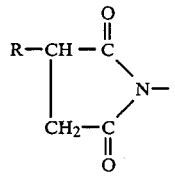

DESCRIPTION OF THE INVENTION

The products of this invention may be prepared from charge hydrocarbyl-substituted mono- or bis-succinimides containing polyamine chain-linked radicals characterized by the formula

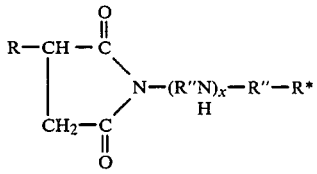

In the above formula, R is a hydrocarbyl group containing about 50–200 carbon atoms, preferably about 80–150 carbon atoms, say about 80 carbon atoms. Typically R is derived from a polyolefin, preferably one having 3–4 carbon atoms in the monomer; and the resultant oligomer, and the R group, have residual unsaturation in the chain. The molecular weight of the oligomer ($\overline{M}_n$) may be 100–10,000, say 300–1300, say 1290. A preferred R group may be the polyisobutylene moiety of $\overline{M}_n$ of 1290.

In the above formula, R″ is a divalent hydrocarbon group which may be alkylene, aralkylene, alkarylene, cycloalkylene, or arylene. When R″ is alkylene, it may be ethylene, propylene, butylene, etc. When R″ is aralkylene, it may be —$C_6H_4$—$CH_2$— etc. When R″ is alkarylene, it may be tolyl, xylyl, etc. When R″ is cycloalkylene, it may be cyclohexylene. When R′ is arylene, it may be phenylene. The groups may be inertly substituted as by alkylene groups, alkoxy groups, etc. The preferred R″ groups are lower alkylene containing 2–4 carbon atoms. Most preferred is ethylene —$CH_2CH_2$—.

In the above formula, R* may be selected from the group consisting of $NH_2$, N(H)R″H,

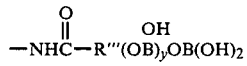

or a hydrocarbyl-substituted succinyl group

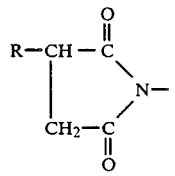

wherein y is 0–3, preferably 0.

Illustrative succinimides which may be used as charge to the process of this invention may include the following:

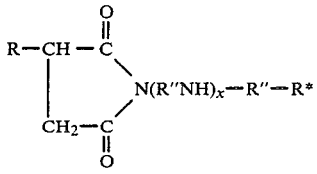

TABLE

A.

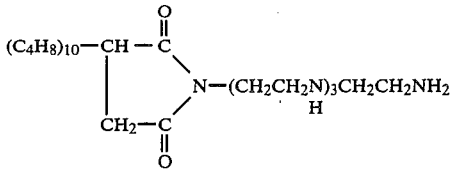

B.

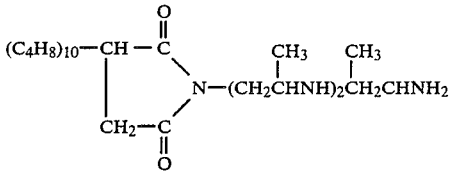

C.

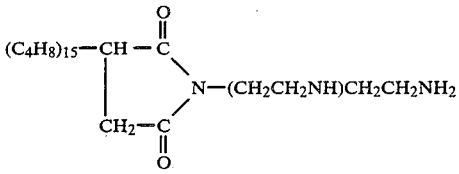

D.

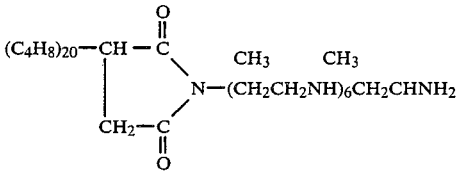

E.

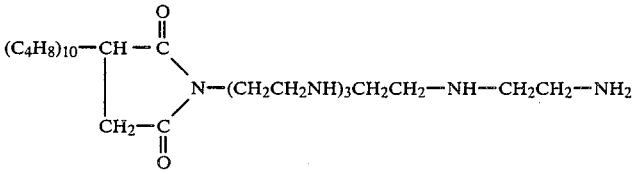

F.

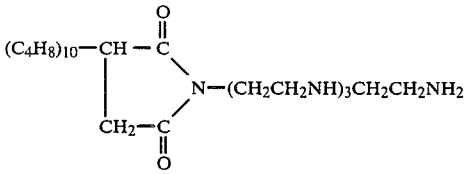

Many of these charge compositions may be prepared by prior art processes including those disclosed in U.S. Pat. No. 3,185,704, etc:

Practice of the process of this invention may be carried out by reacting (i) a hydrocarbyl-substituted mono- or bis-succinimide containing polyamine chain-linked radicals characterized by the formula (ii) a hydroxy acid $$HOOC—R'''—OH$$

and (iii) a boric acid $$H(OB)_yOB(OH)_2$$

thereby forming said product; and recovering said product

The hydroxy acids which may be employed may be characterized by the formula $$HOOC—R'''—OH$$

In this formula, R'''may be a divalent hydrocarbon group selected from the same group as that from which R'' is selected. Preferably R''' may be a lower alkylene group containing 1–4 carbon atoms. The preferred R''' group may be $—CH_2—$ Illustrative hydroxy acids may include:

TABLE

| Acid | Formula |
|---|---|
| Glycolic | $HOCH_2COOH$ |
| Lactic | $CH_2CHOHCOOH$ |
| 2-hydroxymethyl propionic | $CH_2CH(CH_2OH)COOH$ |
| 2,2'-bis-hydroxymethyl propionic | $CH_2(CH_2OH)_2COOH$ |

The preferred acid is glycolic acid.

Although it is preferred to utilize the acids in their free acid form, it may be possible to use the anhydride, the acyl halide, etc.

The boric acids which may be employed in practice of the process of this invention are characterized by the formula:

$$H(OB)_yOB(OH)_2$$
$$OH$$

wherein y is 0–3.

TABLE

| y | Formula |
|---|---|
| 0 | $HOB(OH)_2$ |
| 1 | OH<br>$H(OB)OB(OH)_2$ |
| 2 | OH<br>$H(OB)_2OB(OH)_2$ |
| 3 | OH<br>$H(OB)_3OB(OH)_2$ |

In one embodiment of the process of this invention the charge composition may be characterized by the formula

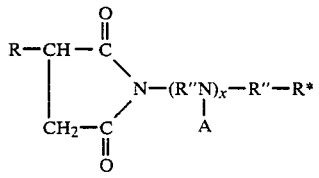

wherein A is hydrogen or a hydroxyacyl group typically selected from the group consisting of glycolyl, lactyl, 2-hydroxymethyl proprionyl and 2,2'-bis-hydroxymethyl propionyl groups. It will be apparent that when A is hydrogen, the charge composition may be the hydrocarbyl-substituted mono- or bis-succinimide containing polyamine chain linked groups as set forth supra. It will also be apparent that, when A is one of the other substituents, the charge composition may be that obtained by the reaction of the (i) hydrocarbyl-substituted mono- or bis-succinimide containing polyamine chain linked groups as set forth supra with (ii) the hydroxy acid, typified by glycolic acid, and having the following typical formula:

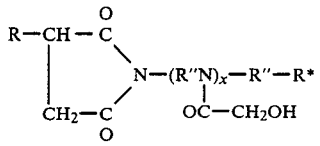

Reaction of this composition with the noted boric acids will yield the desired compounds of this invention.

Reaction may be carried out at atmospheric pressure and 40° C.–180° C. by mixing the components in mole ratio of succinimide: hydroxy acid: boric acid::

1: (1–5, say 4: (1–5, say 2).

It is a feature of the process of this invention that the hydroxy acid and the boric acid may be added to the succinimide either simultaneously or sequentially. If the hydroxy acid is reacted first with the succinimide, the procedure of U.S. Ser. No. 465,941, now U.S. Pat. No. 4,482,464, may be employed followed by addition to the product thereof of the boric acid.

It is however preferred to add the hydroxy acid and the boric acid simultaneously to the succinimide.

It is preferred that reaction be carried out in diluent-solvent. Preferably the succinimide is added to the reaction vessel as a 25–90 w %, say 50 w % solution in a diluent oil. The preferred diluent oils may be hydrocarbon oils which are compatible with the ultimate formulation (e.g. a lubricating oil) with which the product is to be blended. One preferred diluent is the 100 SUS hydrogen finished or solvent refined mineral oil.

It is also preferred that the hydroxy acid be added to the reaction mixture as a solid or a 50–95 w %, say 70 w % solution.

It is also preferred that the boric acid be added to the reaction mixture as a solid or a 5–50 w %, slurry in a diluent oil—preferably the same diluent oil.

In one embodiment, the hydroxy acid and the boric acid may be added in a single solution-slurry.

Reaction may be carried to completion by maintaining the reaction mixture at 100° C.–180° C., say 160° C. to remove water as it is formed over 4–10 hours, say 8 hours. Thereafter the reaction mixture may be filtered hot. On cooling, the product may be recovered as a 25–90 w %, say 50 w % solution in solvent; and it may be employed in this form.

Reaction may be as follows:

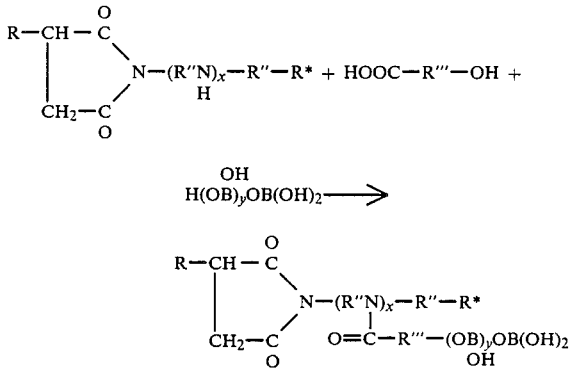

In a preferred embodiment, reaction may be

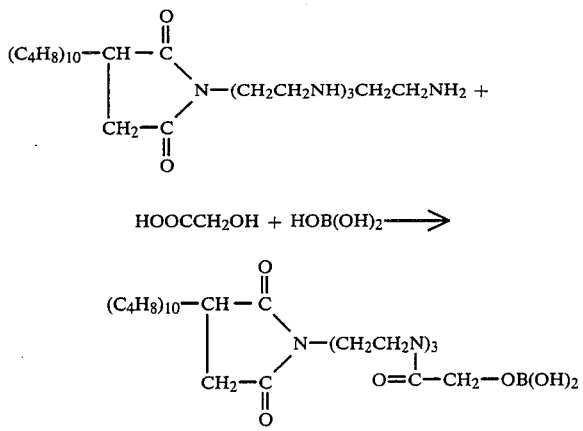

The products of this invention may be added to lubricating oil compositions to impart thereto improved wear protection and dispersancy properties. Typical lubricating oils to which the additives of this invention may be added include summer or winter automotive lubricating oils, airplane engine oils, railway diesel oils, etc. whether hydrocarbon derived or synthetic including ester-type oils etc. Typically the additive may be present in minor effective amount of 0.01–10 w %, preferably 0.1–5 w %, typically 1–4 w %, say about 2 w %.

Addition of the additive to the lubricating oil may be facilitated by use of a concentrate containing 25–90 w %, preferably 50–75 w %, say 50 w % of additive in a diluent-solvent which may in the preferred embodiment be the same as the lubricating oil in which the additive is to be formulated.

It is a feature of the process of this invention that the novel lubricating oils containing a minor effective amount of the additive of this invention may be particularly characterized by improved wear performance as measured in the Standard Sequence III D test, conducted in an Oldsmobile 350 V-8 engine. In this test, the engine is operated at high speed (3000 RPM) for 64 hours. This test measures wear (cam plus lifters), engine deposits, and oil oxidation.

Lubricating oils prepared in accordance with the process of this invention show cam plus lifter wear improved (i.e. decreased) by a factor of 2.5–5.

DESCRIPTION OF SPECIFIC EMBODIMENT

Practice of the process of this invention will be apparent to those skilled in the art from the following wherein as elsewhere in this specification all parts are parts by weight unless otherwise specified. In all compounds, all unfilled valence bonds may be filled with hydrogen atoms or with inert substituents.

EXAMPLE I

In this example, (i) 43.3 g (0.167 moles) of the Dow PEHA brand of E-100 pentaethylene hexamine having the general formula $H_2N(C_2H_4NH)_4C_2H_4NH_2$ having a molecular weight of about 260 and (ii) 395 g of 100 SUS diluent oil were charged to a reaction vessel which was then blanketed with nitrogen and heated to 60° C.

There was then added 400 g (0.185 moles) of the H-300 brand of polyisobutenyl ($\overline{M}_n$ of 1290) succinic acid anhydride (Sap. No. of 51.9) which contained 5.9 w % of 100 SUS diluent oil. Addition proceeded with stirring and the reaction mixture was then heated to 110° C.–120° C. at which it was maintained for 1.5 hours.

There was then added 0.1 ml of silicone oil antifoamant, 22 g (0.37 moles) of boric acid, and 70 g (0.668 moles) of a 72% solution of glycolic acid in water.

The reaction mixture was heated to 160° C. at which temperature it was maintained for 8 hours. Water was removed as it was formed. The product was filtered hot and cooled to yield a 50 w % solution of product in diluent oil.

EXAMPLE II

In this example the procedure and quantities employed in Example I were employed except that the pentaethylene hexamine was present in amount of only 38.5 g (0.148 moles), the diluent oil was present in amount of only 390.5 g, the 72% glycolic acid was present in amount of only 60.0 g (0.57 moles) and the boric acid was present in amount of 21.1 g (0.35 moles).

EXAMPLE III

In this example, the charge included 200 g of charge composition,

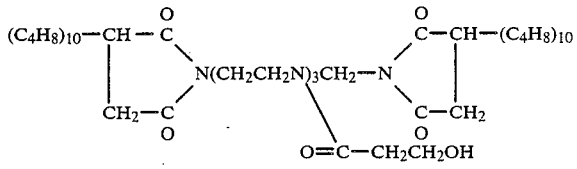

which contained a mole ratio of alkenyl ($\overline{M}_n$ 1290) succinic acid anhydride: amine: glycolic acid of 1:0.55:0.385 and 200 g of diluent oil.

There was also charged 11 g of boric acid. The reactants were heated under a nitrogen blanket to 160° C. for 4 hours. The reaction mixture was filtered hot and the product was recovered.

EXAMPLE IV

In this example, the procedure of Example III was followed except that the charge composition was characterized by a ratio of 1:0.9:3.42.

EXAMPLE V

In this example, the procedure of Example III was followed except that the charge composition was characterized by a ratio of 1.0:0.7:1.5.

Each of these products was analyzed for % nitrogen, % boron, Total Base Number TBN (by ASTM Tests D-664 and D-2896), and Total Acid Number TAN (by ASTM Test D-974). The results are as set forth in the following table:

TABLE

| Example | % NITROGEN | TBN D-664 | TBN D-2896 | TAN D-974 | % BORON |
|---|---|---|---|---|---|
| I | 1.72 | 23.5 | 26.8 | 20.4 | 0.44 |
| II | 1.44 | 22.1 | 25.3 | 19.3 | 0.42 |
| | 1.09 | 14.2 | 18.8 | 6.02 | 0.42 |
| III | 0.83 | 3.98 | 7.43 | 8.12 | 0.51 |
| | | 3.31 | | | |
| IV | 1.22 | 4.65 | 13.0 | 14.2 | 0.45 |
| | | 4.91 | | | |
| V | 1.04 | 8.14 | 14.3 | 13.2 | 0.48 |
| | | 8.23 | | | |

EXAMPLES VI–IX

In this series of tests, the Wear-Improving properties of the formulations of the invention were tested by the Sequence III D test conducted in an Oldsmobile 350 V-8 engine. This test measures wear, oxidation, and deposit protection of automotive motor lubricating oils.

A standard SAE 30 lubricating oil formulation was prepared which contained (i) a zinc dialkyldithiophosphate oxidation and wear inhibitor (1.2 w %), (ii) a calcium sulfonate detergent (1.2 w %), (iii) a polymethacrylate pour point depressant (0.5 w %), and (iv) a copper carboxylate (0.1 w %).

In addition, the following were present in the noted Examples:

| Examples | Additive |
|---|---|
| VI* | Unsubstituted succinimide prepared according to the first two paragraphs of Example I, but using an equal molar amount of triethylenetetramine in place of the PEHA. |
| VII* | Borated succinimide prepared by the procedure of Example VI except for the addition of boric acid. |
| VIII* | Glycolated succinimide prepared by the procedure of Example IV except for the omission of boric acid from the reaction mixture. |
| IX | Borated-glycamide prepared as in Example IV. |

The results of the Sequence III D Test were as follows:

TABLE

| Example Seq. IIID | Cam Plus Lifter Wear ($\times 10^3$ inch) Average | Maximum |
|---|---|---|
| VI* | 3.4 | 19.7 |
| VII* | 3.5 | 23.6 |
| VIII* | 6.6 | 39.2 |
| IX | 1.4 | 2.5 |
| | 4.0 | 8.0 |

API Limits: Max.
*Control Examples

From the above Table, it is apparent that the system of this invention permits attainment of results which average 2.5–4.5 better than control examples.

Although this invention has been illustrated by reference to specific embodiments, it will be apparent to those skilled in the art that various changes and modifications may be made which clearly fall within the scope of this invention.

What is claimed is:

1. A hydrocarbyl-substituted mono-or bis-succinimide containing polyamine chain-linked hydroxyacyl radicals characterized by the formula

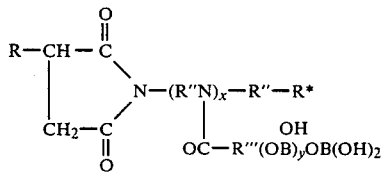

wherein

R is a hydrocarbyl group containing about 8–400 carbon atoms;

R″ is a divalent hydrocarbon group;

x is 1–6;

y is 0–3;

R‴ is a divalent hydrocarbon group;

R* is —$NH_2$, —N(H)R″H

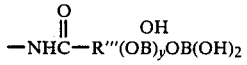

or a hydrocarbyl-substituted succinyl group

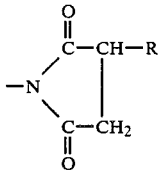

2. A hydrocarbyl-substituted mono-or bis-succinimide as claimed in claim 1 wherein said R group contains about 80–150 carbon atoms.

3. A hydrocarbyl-substituted mono-or bis-succinimide as claimed in claim 1 wherein x is zero.

4. A hydrocarbyl-substituted mono-or bis-succinimide as claimed in claim 1 wherein x is 2–4.

5. A hydrocarbyl-substituted mono-or bis-succinimide as claimed in claim 1 wherein R″ contains two carbon atoms.

6. A hydrocarbyl-substituted mono-or bis-succinimide as claimed in claim 1 wherein R″ contains a pendant hydroxyl group.

7. A hydrocarbyl-substituted mono-or bis-succinimide as claimed in claim 1 wherein R* is —$NH_2$.

8. A hydrocarbyl-substituted mono -or bis-succinimide as claimed in claim 1 wherein R‴is —$CH_2$—.

9. A hydrocarbyl-substituted mono-or bis-succinimide as claimed in claim 1 wherein y is zero.

10. A hydrocarbyl-substituted mono-or bis-succinimide containing polyamine chain-linked hydroxyacyl radicals characterized by the formula

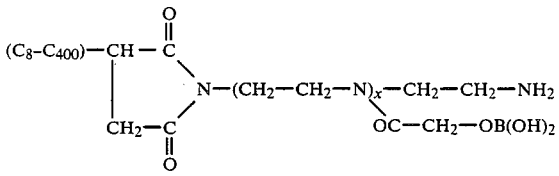

wherein x is 1–6.

11. The method of preparing a product hydrocarbyl-substituted mono-or bis-succinimide containing polyamine chain-linked hydroxyacyl radicals characterized by the formula

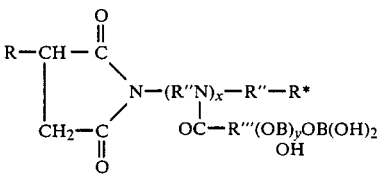

wherein

R is a hydrocarbyl group containing about 8–400 carbon atoms;

R″ is a divalent hydrocarbon group;

x is 1–6;

y is 0–3;

R‴ is a divalent hydrocarbon group;

R* is —$NH_2$, —N(H)R″H,

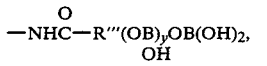

or a hydrocarbyl-substituted succinyl group

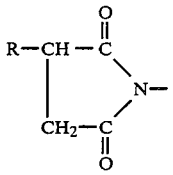

which comprises reacting:

(i) a hydrocarbyl-substituted mono-or bis-succinimide containing polyamine chain-linked radicals characterized by the formula

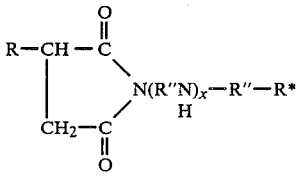

(ii) a hydroxy acid

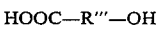

and (iii) a boric acid

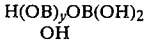

thereby forming said product; and recovering said product.

12. The method of claim 11 wherein said reaction is carried out in the presence of inert diluent.

13. The method of claim 11 wherein said reaction is carried out at 40° C.–180° C.

14. The method of claim 11 wherein said hydroxy acid and said boric acid are added to said succinimide.

15. The method of claim 11 wherein said hydroxy acid and said boric acid are added substantially simultaneously.

16. The method of claim 11 wherein said boric acid is added to the reaction after said hydroxy acid has reacted with said succinimide.

17. The method which comprises reacting (i) a poly isobutenyl ($\overline{M}_n$ of 100–10,000) polyethylene imine succinimide

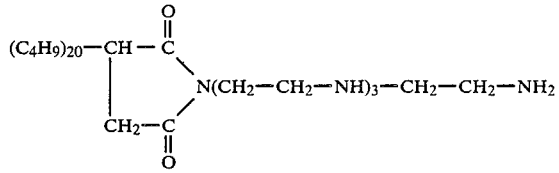

(ii) a hydroxy acid HOOC—$CH_2$OH and, (iii) a boric acid HOB(OH)$_2$ in inert diluent at 40° C.–180° C. thereby forming product; and recovering said product.

18. A lubricant composition comprising a major portion of a lubricating oil and a minor effective amount of as additive a hydrocarbyl-substituted mono-or bis-succinimide containing polyamine chain-linked hydroxyacyl radicals characterized by the formula

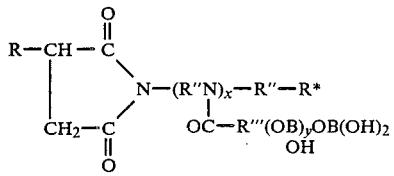

wherein

R is a hydrocarbyl group containing about 8–400 carbon atoms;

R″ is a divalent hydrocarbon group;

x is 1–6;

y is 0–3;

R‴ is a divalent hydrocarbon group;

R* is —$NH_2$, —N(H)R″H,

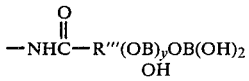

or a hydrocarbyl-substituted succinyl group

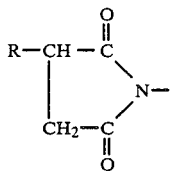

19. A lubricant composition as claimed in claim 18 wherein a hydrocarbyl-substituted mono-or bis-succinimide as claimed in claim 1 wherein x is zero.

20. A lubricant composition as claimed in claim 18 wherein a hydrocarbyl-substituted mono-or bis-succinimide as claimed in claim 1 wherein x is 2–4.

21. A lubricant composition as claimed in claim 18 wherein R″ contains two carbon atoms.

22. A lubricant composition as claimed in claim 18 wherein R″ contains a pendant hydroxyl group.

23. A lubricant composition as claimed in claim 18 wherein R* is —$NH_2$.

24. A lubricant composition as claimed in claim 18 wherein R‴is —$CH_2$—.

25. A lubricant composition as claimed in claim 18 wherein y is zero.

26. A lubricant composition as claimed in claim 18 wherein said additive is present in amount of 1–5 w % of said lubricating oil.
27. A lubricant composition as claimed in claim 18 wherein said additive is
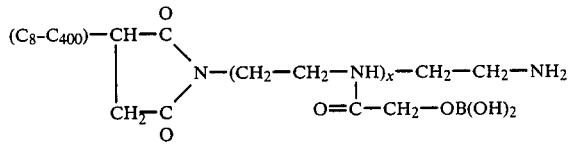
wherein x is 1–6.
* * * * *